US006561251B1

(12) United States Patent
Prosch

(10) Patent No.: US 6,561,251 B1
(45) Date of Patent: May 13, 2003

(54) VERTICAL VENETIAN BLIND

(76) Inventor: Dieter Prosch, Flachsland 39, 22083 Hamburg (DE)

( * ) Notice: Subject to any disclaimer, the term of this patent is extended or adjusted under 35 U.S.C. 154(b) by 102 days.

(21) Appl. No.: 09/758,028

(22) Filed: Jan. 10, 2001

(30) Foreign Application Priority Data

Jan. 14, 2000 (DE) ..... 200 00 651

(51) Int. Cl.[7] ..... E06B 3/48
(52) U.S. Cl. ..... 160/115; 160/900
(58) Field of Search ..... 160/115, 176.1 R, 160/176.1 V, 177 V, 113, 114, 900

(56) References Cited

U.S. PATENT DOCUMENTS 1,095,292 A * 5/1914 Smith ..... 160/115
4,657,061 A * 4/1987 Meier ..... 160/115
5,139,071 A * 8/1992 Danchulis ..... 160/115
5,597,026 A * 1/1997 Fuentes et al. ..... 160/115

* cited by examiner

*Primary Examiner*—David M. Purol
(74) *Attorney, Agent, or Firm*—Friedrich Kueffner

(57) ABSTRACT

The vertical Venetian blind (100) consists of vertical lamellae (10), held in a support rail (15) and travelling in the support rail longitudinal direction by an operating cord (17) and swivellable about their vertical longitudinal axes (11) by an operating chain (16) for opening and closing, which constitute, when closed, a curtain-type Venetian blind (200), these vertical lamellae (10) being made of strip shaped cut-out pieces made of a weft, cloth or foil, the vertical lamellae (10) being connected with each other at their lower free ends **(10*c*) with connecting cords, chains or bead chains (13) held on their outer marginal edges (10*a*, 10*b*), whereby at least one section (90) with manually adjustable vertical lamellae (120), situated in the lower Venetian blind area, is constituted in the Venetian blind (200) formed by the vertical lamellae (10)**.

13 Claims, 8 Drawing Sheets

VERTICAL VENETIAN BLIND

BACKGROUND OF THE INVENTION

The invention relates to a vertical Venetian blind according to the preamble of claim 1.

Such vertical Venetian blinds consist of vertical lamellae, held in a support rail and travelling in the support rail longitudinal direction by means of an operating cord and swivellable about their vertical longitudinal axes by means of an operating chain for opening and closing, which constitute, when closed, a curtain-type Venetian blind, these vertical lamellae being made of strip shaped cut-out pieces made of a weft, cloth or foil, the vertical lamellae being connected with each other at their lower free ends with connecting cords, chains or bead chains held on their outer marginal edges so that, when closed, the vertical lamellae constitute a curtain-type Venetian blind, whereas light can penetrate through the Venetian blind, when in the completely or partially opened state which is obtained by twisting of the vertical lamellae about their vertical axes. With the known vertical Venetian blinds, it is however not possible to create separate light transmitting sections and sections which are not light transmitting, since all vertical lamellae together can only be closed or opened so that, when closed, no light can penetrate through. Even in the only completely or partially opened state, light always penetrates through the Venetian blind surface. However, often no light incidence is desired in certain Venetian blind areas, particularly when light is felt as being disturbing for working, for example at the computer.

Therefore, the aim of this invention is to create a vertical Venetian blind according to the type described in the introduction for which simultaneously light transmitting areas and areas which are not light transmitting can be constituted, whereby a complete opening and closing of the Venetian blind is also possible so that the person which is in a room, for example, in an office with computers with a window equipped with a vertical Venetian blind can adjust and regulate by itself the respectively necessary light conditions.

SUMMARY OF THE INVENTION

This aim is achieved for a vertical Venetian blind of the type according to the kind by the characteristics indicated in claim 1.

Accordingly, the vertical Venetian blind according to the invention is configured in such a way that a section with manually adjustable vertical lamellae is constituted in the lower Venetian blind area in the Venetian blind formed by the vertical lamellae.

The invention further relates to at least one vertical lamella of the vertical lamellae constituting the Venetian blind which is constituted by two parts and which shows an upper lamella section and a lower lamella section which can be twisted about its vertical axis to the upper lamella section in angular positions up to at least 90° to the upper lamella section by means of a lockable rotary holding device so that the lower lamella section can be transferred into an angular position of 90° to the upper lamella section.

With such a configuration according to the invention of a vertical Venetian blind, it is possible, depending on the arrangement and number of the vertical lamellae constituted by two parts, to obtain a Venetian blind with which different light conditions can be created so that, for example, a person working at a computer can darken the area of the Venetian blind which causes, when opened, a disturbing light incidence, whereas other sections or areas of the Venetian blind can be opened for an incidence of light. Thus, it is possible to adjust the light conditions quite individually and to adapt them to the respective requirements.

Further advantageous configurations of the invention are the object of the subclaims.

According to an advantageous embodiment of the invention, at least one vertical lamella of the vertical lamellae constituting the Venetian blind consists of at least two superimposed lamella sections complementing to the whole length of the vertical lamellae, whereby both lamella sections are connected with each other over the rotary holding device which consists of two retaining clamps twistable about a common vertical middle axis, placed superimposed, the upper retaining clamp being fixed to the lower free end of the respectively upper lamella section and the lower retaining clamp being held at the upper end of the respectively lower lamella section of the vertical lamella. The swivelling range or rotating range of both retaining clamps to each other is limited by means of a locking device, whereby the upper lamella sections and the remaining vertical lamellae are travelling by means of the operating cord and/or the operating chain and/or are swivellable about their vertical axes and the lower lamella sections are manually swivellable and/or swivellable over the upper lamella sections about their vertical rotation axes.

All vertical lamellae which constitute the Venetian blind consist of respectively two lamella sections connected over the rotary holding devices, whereby both lamella sections of each vertical lamella can have the same length or a different length.

Each rotary holding device which respectively connects two lamella sections consists of two superimposed arranged retaining clamps configured as flat bars with approximately rectangular or square recesses configured at the end thereof with openings changing into the respectively upper longitudinal edges of the flat bars, whereby both flat bars have in the middle of their longitudinal edges turned to each other respectively one circular or partially circular disk body, the disk body on the upper retaining clamp being provided with a journal and the disk body on the lower retaining clamp having a bore hole for receiving the journal for constituting the rotation axis. The locking device consists of a curved, particularly of a curved oblong hole in the shape of a quarter of a circle or of a groove in the disk body of the lower retaining clamp of the rotary holding device and of a cam engaging into the oblong hole on the lower side of the disk body of the upper retaining clamp of the rotary holding device so that in parallel position of both retaining clamps the cam of the upper retaining clamp rests in the one end area of the oblong hole and in right-angled position of both retaining clamps to each other the journal rests in the other end area of the oblong hole.

The rotary holding device with its retaining clamps consists of plastic, the flat bars of the retaining clamps of the rotary holding device having a length which is bigger than the width of the individual vertical lamellae so that the free ends with the recesses of the flat bars project laterally from the lamella sections.

The partially circular oblong hole on the disk body of the lower retaining clamp of the rotary holding device approximately corresponds to the length of a quarter of a circle.

The lower lamella sections of the vertical lamellae are connected with each other on both sides in the area of their lower free ends over connecting chains, bead chains or connecting cords, the upper lamella sections of the vertical lamellae being connected with each other on both sides in the area of their lower ends over connecting chains, bead chains or connecting cords.

BRIEF DESCRIpTION OF THE DRAWINGS

Embodiments of the invention will be explained in detail with reference to the drawings.

DETAILED DESCRIPTION OF THE PREFERRED EMBODIMENT

Figure 1:
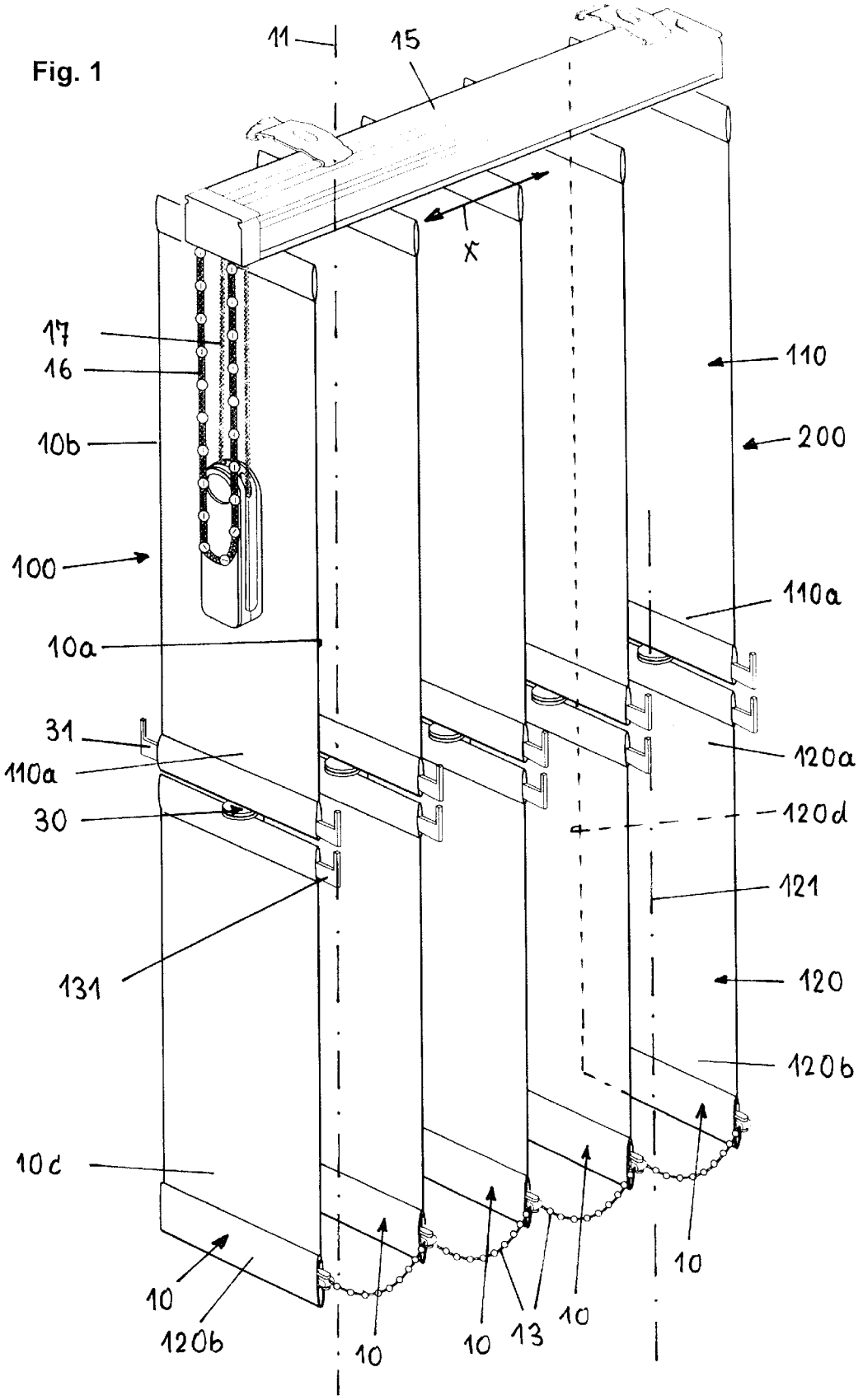
FIG. 1 is a graphical view of a vertical Venetian blind with vertical lamellae showing an upper and a lower lamella section, the Venetian blind being open, the upper and the lower lamella sections being connected with each other over a rotary holding device.

The vertical Venetian blind 100 represented in the FIGS. 1, 2, 3, 7, 8, 9 and 10 consists of vertical lamellae 10 held in a support rail 15 which can be fixed to a ceiling or a vertical wall, the number of which is respectively adapted to the size of the Venetian blind 200 to produce. These vertical lamellae 10 are held in the support rail 15 and travelling in the support rail 15 by means of an operating cord 17 in direction of the arrow X. Furthermore, the vertical lamellae 10 are provided with their upper ends with holding devices which are travelling in the inner space of the support rail 15 and which enable a twisting of the vertical lamellae 10 about their vertical longitudinal axis 11. The twisting of the vertical lamellae 10 about their vertical longitudinal axis 11 ensues by means of an operating chain 16, which is preferably configured as a bead chain. The vertical lamellae 10 are closed or opened by swivelling by means of this operating chain 16.

The vertical lamellae 10 consist of strip-shaped cut-out pieces of a weft, a cloth, a foil or of other appropriate materials.

The vertical lamellae 10 are connected with each other at their lower free ends 10*c*, namely with connecting cords, chains or bead chains 13 which are held on their outer marginal edges 10*a*, 10*b* (FIG. 1). In the Venetian blind 200 constituted by the vertical lamellae 10, at least one section 90 situated in the lower Venetian blind area is configured with vertical lamellae or lamella sections 120 which are manually adjustable, this section being configured according to FIG. 7 in the middle area of the Venetian blind 200. For the embodiment according to FIG. 8, two sections 90 are constituted which are provided for in the end areas of the Venetian blind 200, while according to FIG. 9 the area 90 extends over the whole lower longitudinal area of the Venetian blind 200. According to FIG. 10, two sections 90 are constituted in the Venetian blind 200.

Figure 2:
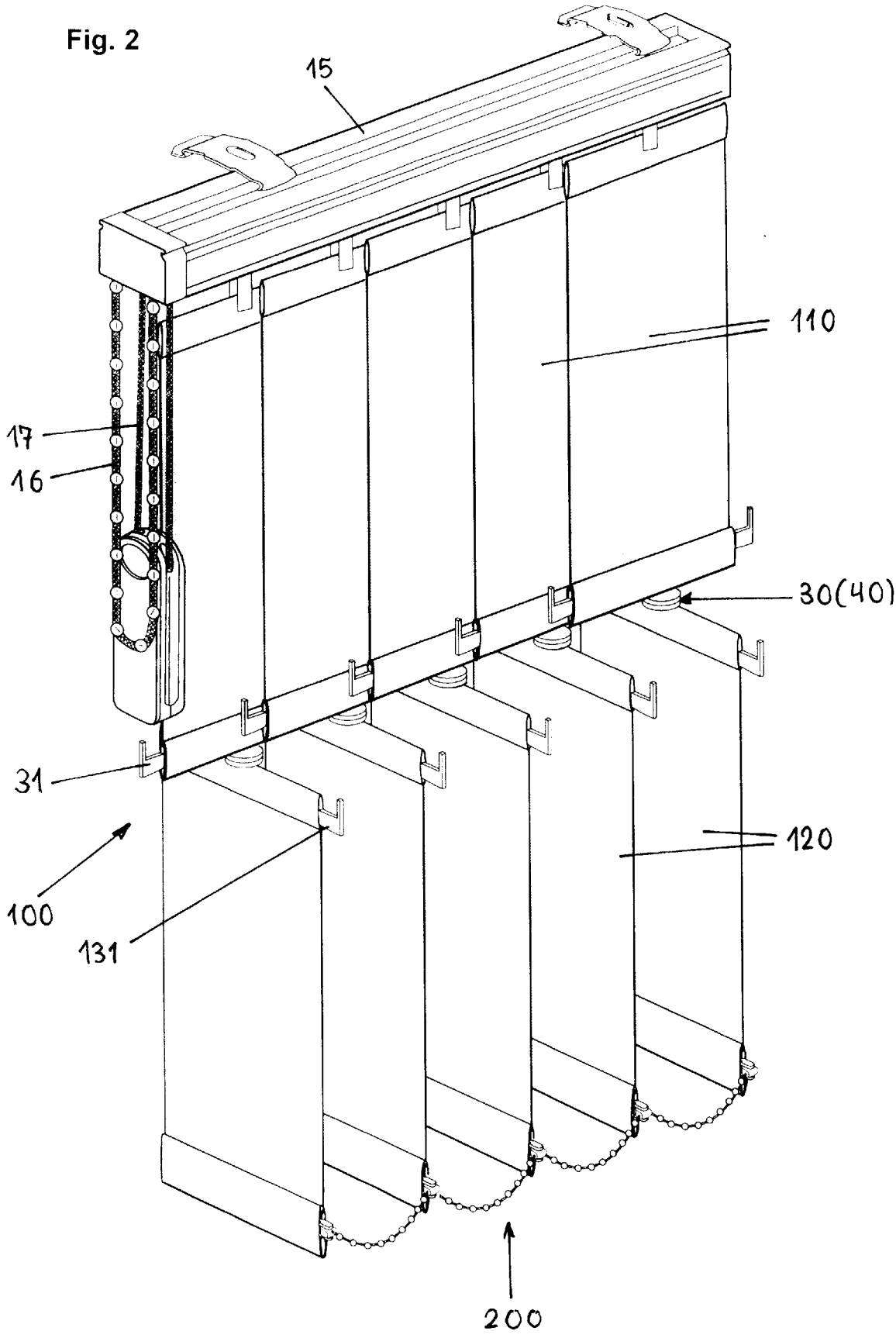
FIG. 2 is a graphical view of the vertical Venetian blind according to FIG. 1, however with a closed upper area, the lower lamella sections being at right angles to the upper lamella sections.
Figure 3:
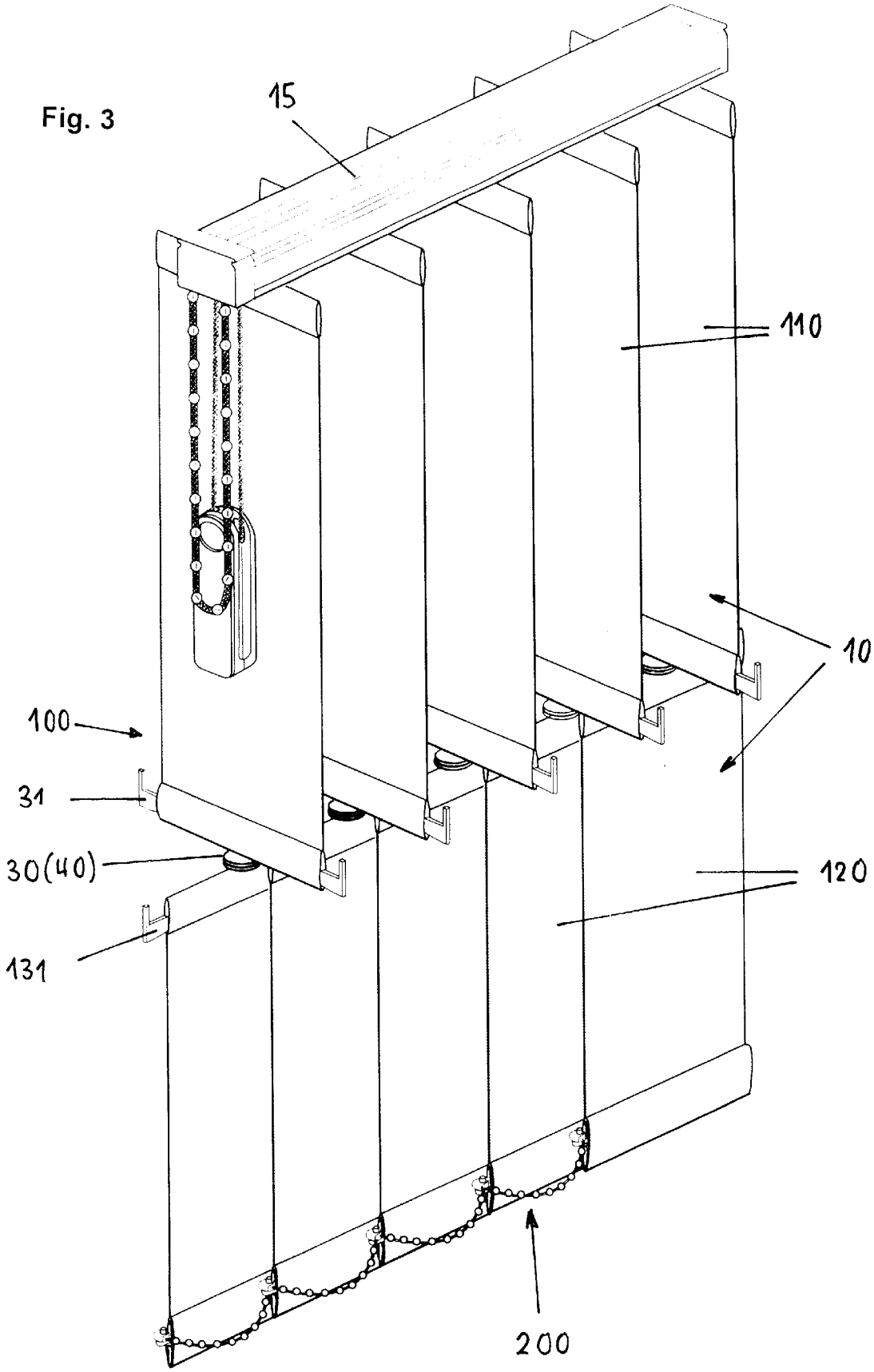
FIG. 3 is a graphical view of the vertical Venetian blind according to FIG. 1, however with an opened upper area and a closed lower area, the upper lamella sections being at right angles to the lower lamella sections.
Figure 4:
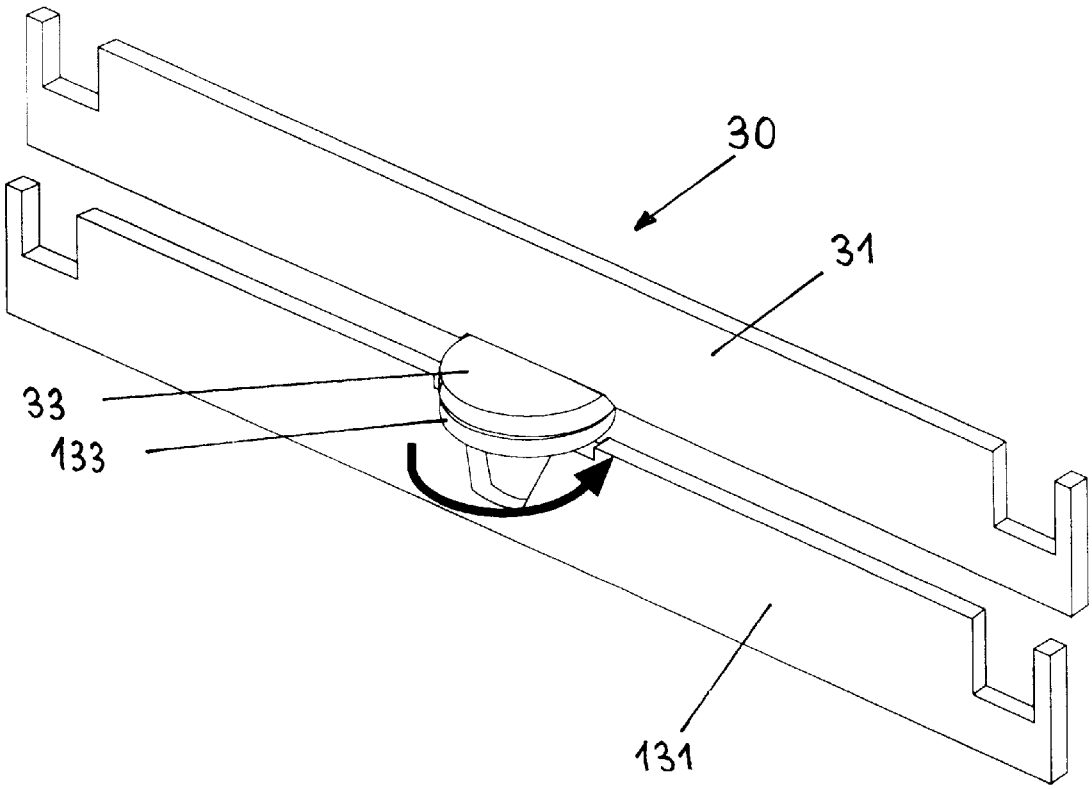
FIG. 4 is a graphical view of the rotary holding device consisting of two retaining clamps for the upper lamella sections and for the lower lamella sections in the position of the retaining clamps when the Venetian blind is open according to FIG. 1.

FIGS. 1, 2 and 3 show a vertical Venetian blind 100 with five vertical lamellae 10, the number of the vertical lamellae being respectively adapted to the width of the Venetian blind 200 to produce.

At least one vertical lamella 10 of the vertical lamellae 10 which constitute the Venetian blind 200 is configured divided into two parts. For the embodiment shown in FIGS. 1, 2 and 3, all vertical lamellae 10 are configured in two parts and thus consist of an upper lamella section 110 and of a lower lamella section 120. The lower lamella section 120 is manually twistable about its vertical axis 121 to the upper lamella 110 in angular positions up to at least 90° to the upper lamella section, what takes place by means of a lockable rotary holding device 30 which is placed between the upper lamella section 110 and the lower lamella section 120 in such a way that both lamella sections are connected with each other and held together. Due to this twistability by means of this rotary holding device 30, the respective lower lamella section 120 can be brought into an angular position of 90° to the respective upper lamella section 110 (FIGS. 1 and 3). Also the number of the vertical lamellae 10 of a Venetian blind 200 which are configured in two parts depends on the one hand on the size of the Venetian blind 200 and on the other hand on the possible or desired settings of the lamellae for creating respectively necessary or desired light conditions, the lower lamella sections 120 being namely twisted to the upper lamella sections 110 about their vertical rotation axes 121. Independently of this twistability of the lower lamella sections 120 to the upper lamella sections 110, the upper lamella sections 110 are travelling in direction X on the support rail 15, namely together with the lower lamella sections 120 if, for example, the window surface has to be completely cleared, for example for cleaning or in case particularly good light conditions are to be created in the adjacent rooms. Furthermore, the upper lamella sections 110 are twistable by means of the operating chain 16 about their vertical longitudinal axes and can thus take an opened position (FIG. 1) or a partially closed position.

FIG. 1 shows the Venetian blind 200, the vertical lamellae being opened, whereby according to FIG. 2 the upper lamella sections 110 which constitute the upper area of the Venetian blind 200 are closed and the lower lamella sections 110 are opened. According to FIG. 3, the upper lamella sections 110 are opened and the lower lamella sections 120 are closed. With this embodiment, light can thus penetreate through the Venetian blind 200 only in the upper area, whereas in the position according to FIG. 2 a darkening takes place in the upper Venetian blind area, while light can penetrate through the lower area of the Venetian blind.

Each vertical lamella 10, as far as the vertical lamellae in the Venetian blind 200 are to be configured in two parts, consists of at least two superimposed arranged lamella sections 110, 120, which complement each other to the whole length of the vertical lamellae 10, which are connected with each other over the rotary holding device 30.

This rotary holding device 30 consists of two retaining clamps 31, 131 which can be twisted to each other over a common vertical middle axis 30*a* and which are arranged superimposed, the upper retaining clamp 31 being fixed to the lower free end 110*a* of the respectively upper lamella section 110 and the lower retaining clamp 131 being held at the upper end 120*a* of the respectively lower lamella section 120 (FIGS. 1, 2, 3 and 4). As FIGS. 1, 2 and 3 show, the retaining clamps 31, 131 are placed and held in loop-shaped end sections of the upper lamella sections 110 and of the lower lamella sections 120.

The swivelling and rotating range of both retaining clamps 31, 131 to each other is limited by means of a locking device 40, the upper lamella sections 110 and the remaining vertical lamella sections 10 being travelling by means of the operating cord 17 and/or of the operating chain 16 and being swivelling about their vertical axes 11 and 121 and the lower lamella sections 120 being swivellable manually and/or over the upper lamella sections 110 about their vertical rotation axes. Since the rotary holding device 30 is configured in such a way that a pulling effect is achieved, it is possible to control the swinging in and out of the lower lamella sections 120 also over the swivellability of the upper lamella sections 110 in connection with the upper vertical lamellae 10.

As FIGS. 1 to 3 show, several of the vertical lamellae which constitute the Venetian blind 200 consist of respectively one upper lamella section 110 and respectively one lower lamella section 120, the upper lamella sections being connected with the lower lamella sections 120 over the rotary holding devices 30, the lower lamella sections being held together with their free lower ends 120*b* by means of bead chains, chains or cords 13 which are held on the outer marginal edges 120*c*, 120*d* of the lower lamella sections so that, when only a single lower lamella section 120 swivels, the remaining lower lamella sections 120 participate in this swivelling movement, whereby it is also possible to connect the lower retaining clamps 131 of the rotary holding device 30 with each other by means of bead chains, chains or cords correspondingly to the bead chains, chains or cords 13.

According to an embodiment, the upper lamella sections 110 which constitute the vertical lamellae and the lower lamella sections 120 can have the same length. However, it is also possible to configure the lamella sections 110, 120 so that they have a different length, i.e. the upper lamella sections 110 can have a bigger length than the lower lamella sections 120, whereby a reverse configuration is also possible.

Each rotary holding device 30 which connects respectively two lamella sections 110, 120 consists of two superimposed arranged retaining clamps 31, 131 configured as flat bars 31', 131'. These flat bars 31', 131' have at their ends approximately rectangular or square recesses 32, 32' and 132, 132' with openings 32*a*, 32'*a* and 1321, 132'*a* changing into the respectively upper longitudinal edges 31*a*, 31'*a* of the flat bars 31', 131' so that, because of this configuration, hook-shaped end sections are formed which serve for holding and receiving bead chains, chains or cords 13, when the lower lamella sections 120 are to be connected with each other on the upper side or in case the upper lamella sections 110 are to be connected at their ends in the lower area.

Both flat bars 31', 131' of both retaining clamps 31, 131 of the rotary holding device 30 show in the middle of their longitudinal edges 31'*b*, 131'*a* turned to each other respectively a circular or partially circular disk body 33, 133. Both disk bodies 33, 133 are congruent with each other. Among the disk bodies 33, 133, the disk body 33 on the upper retaining clamp 31 is provided with a journal 35. The disk body 133 on the lower retaining clamp 31 has a bore hole 36 for receiving the journal 35 for constituting the rotation axis 30*a* so that both retaining clamps 31, 131 are twistable to each other about this rotation axis 30*a* (FIG. 5).

Figure 5:
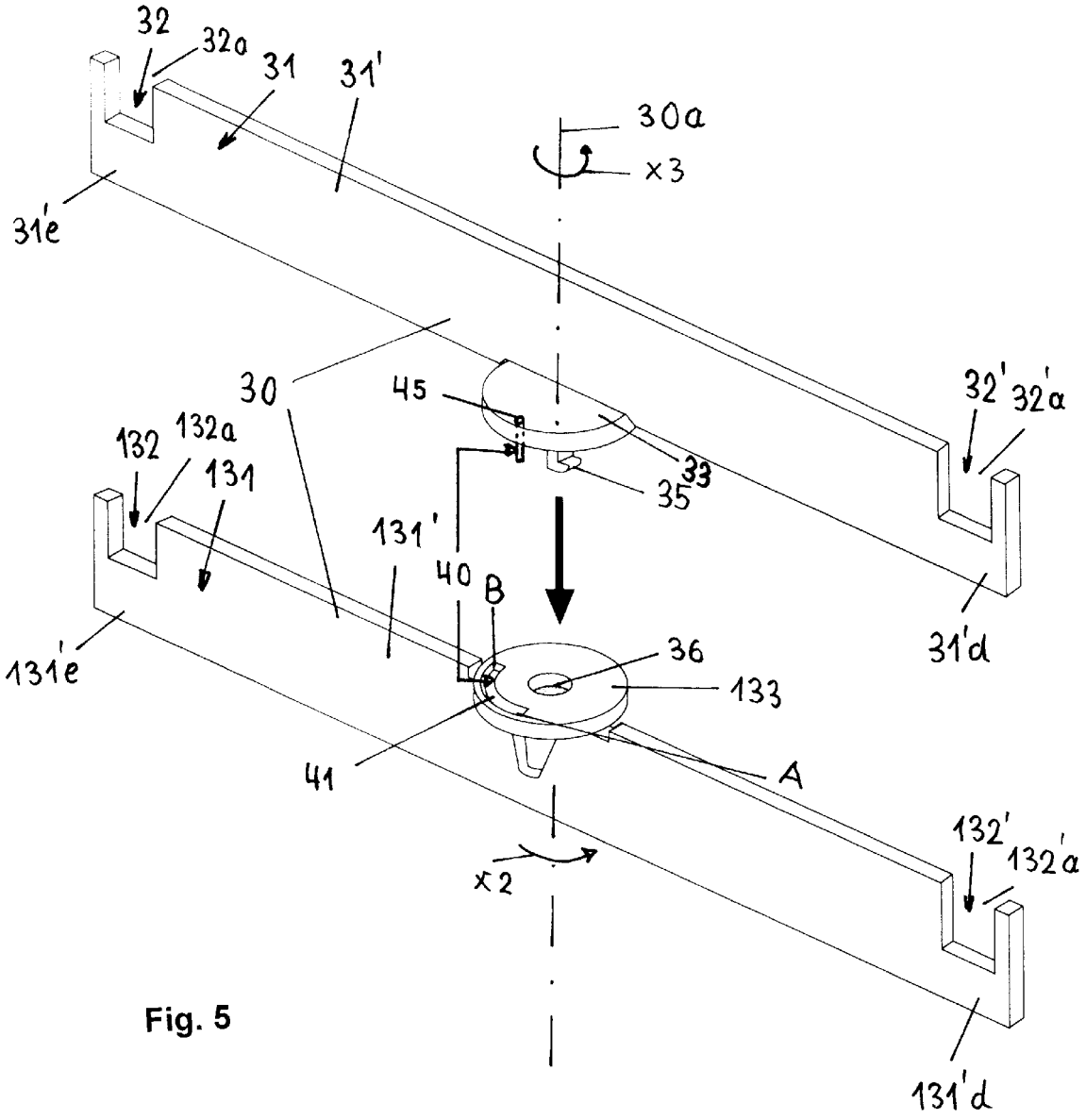
FIG. 5 is a view of the rotary holding device with an exploded view of its two retaining clamps.
Figure 6:
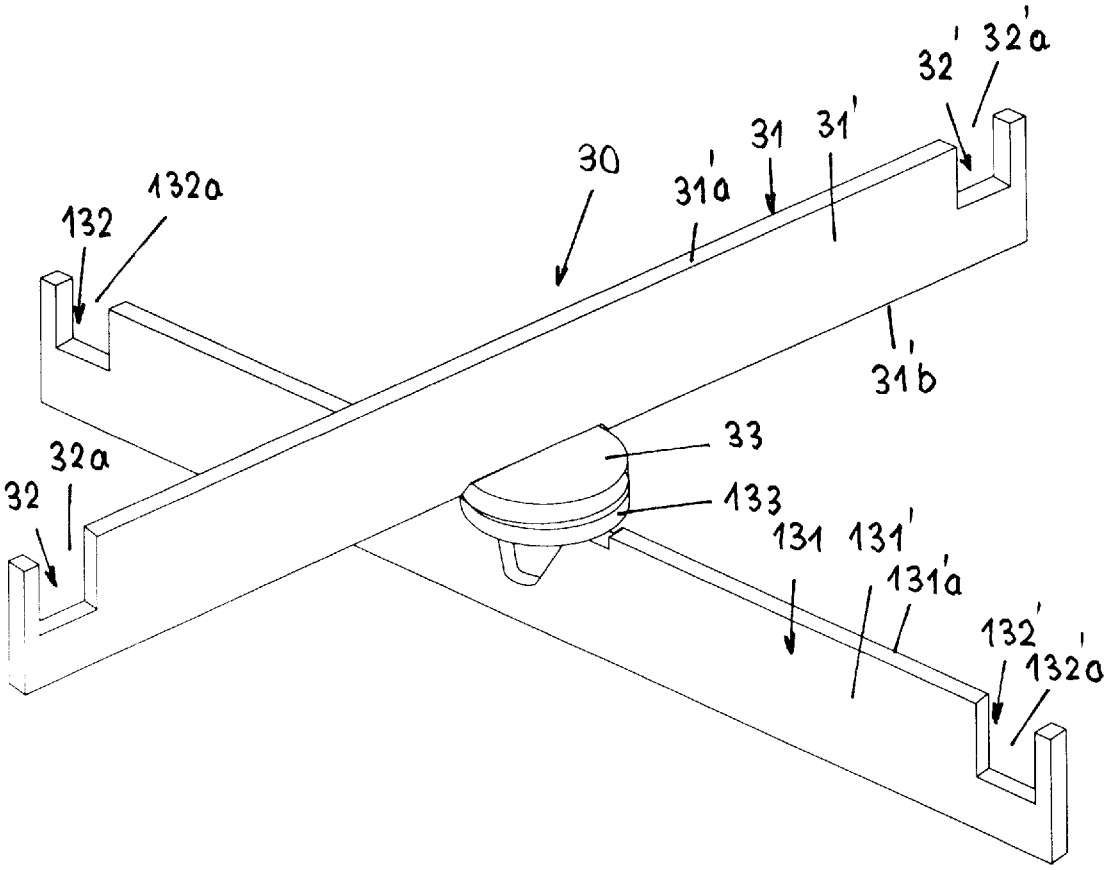
FIG. 6 is a graphical view of the rotary holding device in the position of the two retaining clamps in which both lamella sections are at right angles to each other according to FIGS. 2 and 3.
Figure 7:
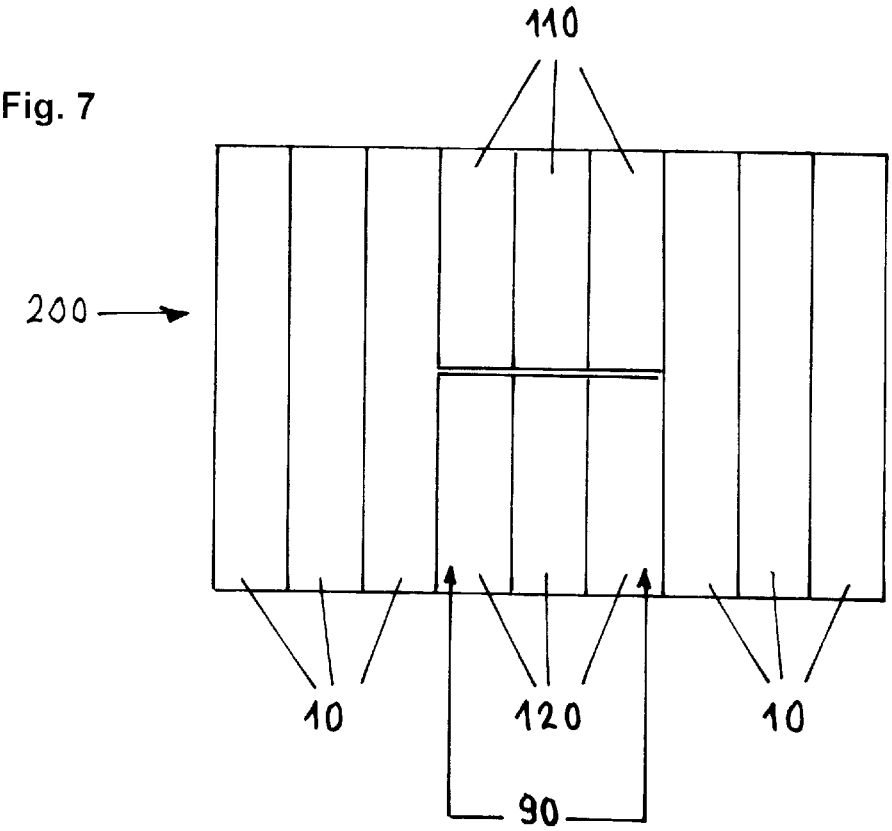
FIGS. 7 to 10 are schematic views of different arrangements of vertical Venetian blinds with continuous and with vertical lamellae divided in two parts.
Figure 8:
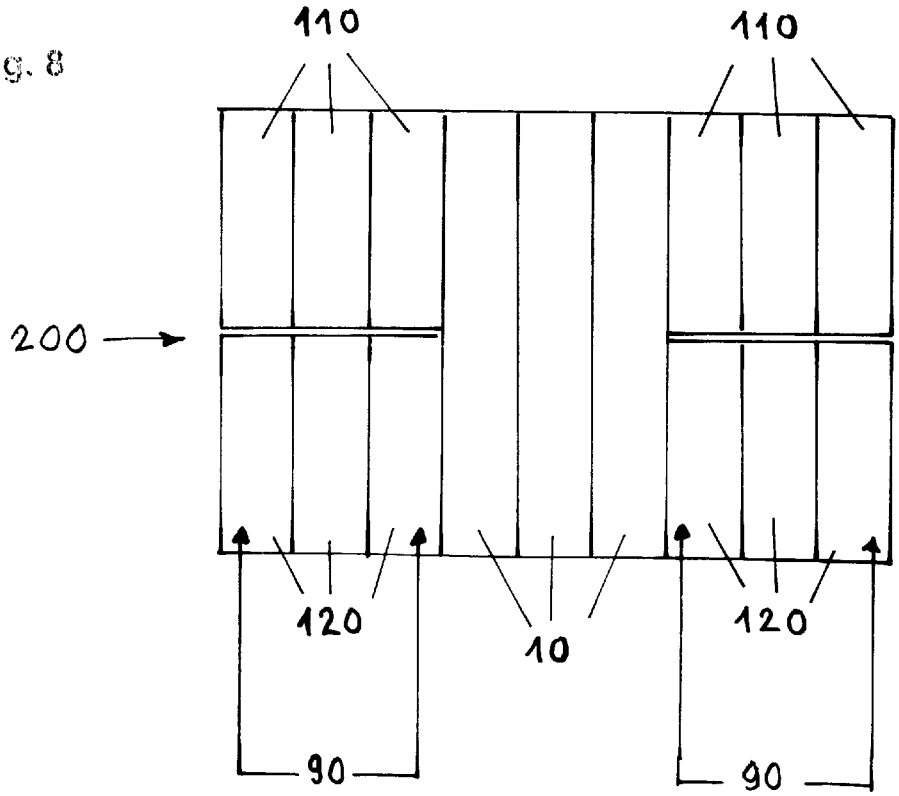
Figure 9:
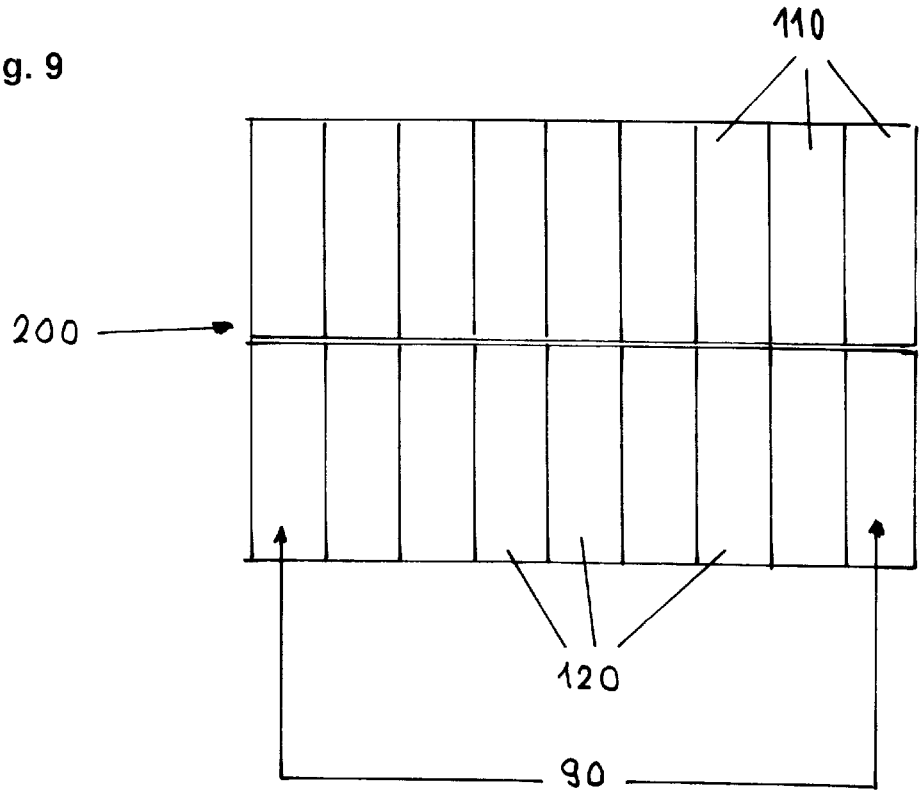
Figure 10:
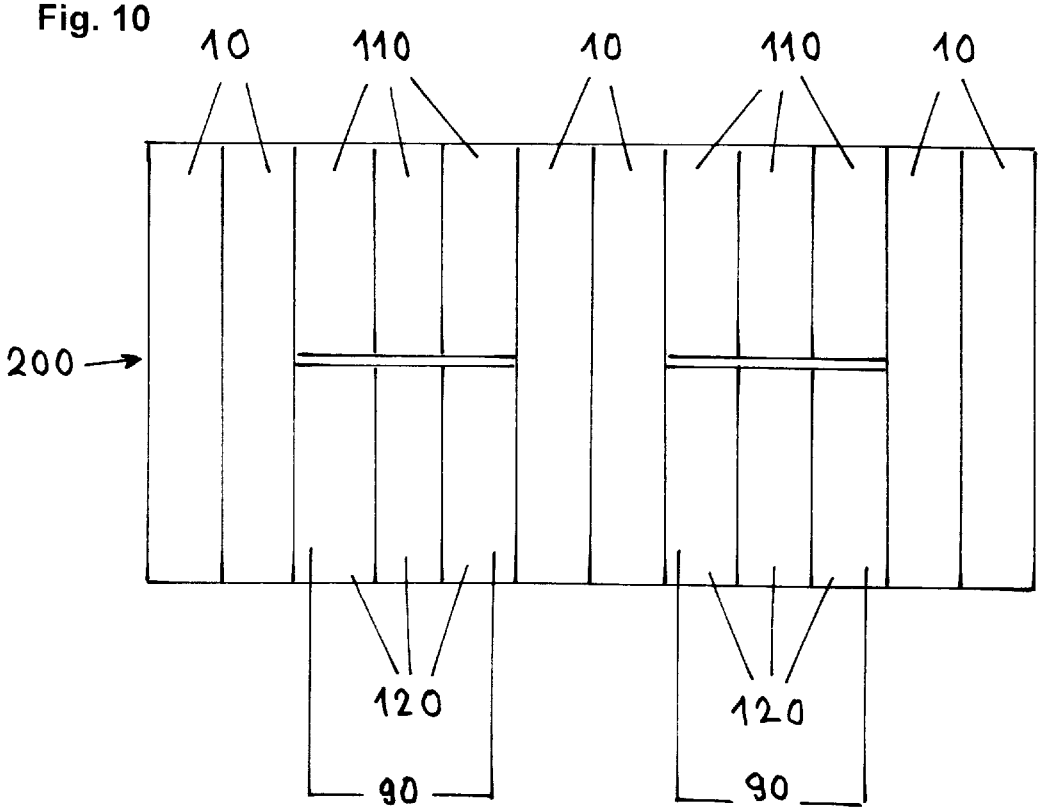

In order to be able to twist both retaining clamps 31, 131 and thus also the upper lamella sections 110 and the lower lamella sections 120 to each other so that there results an arrangement of the retaining clamps in a right angle and that no overtwisting over this angular area is possible, the locking device 40 on both retaining clamps 31, 131 consists of a curved, particularly of a curved oblong hole in the shape of a quarter of a circle or of a groove 41 which is made in the disk body 133 of the lower retaining clamp 131 of the rotary holding device 30 (FIGS. 5 and 6). Moreover, the locking device 40 comprises a cam 45 engaging into the oblong hole 41 which is configured on the lower side of the disk body 33 of the upper retaining clamp 31 of the rotary holding device 30. The cam 45 works together with the oblong hole or with the groove 41 in such a way that, when both retaining clamps 31, 131 are in a parallel position, the cam 45 of the upper retaining clamp 31 rests in the one end area of the oblong hole 41 and when both retaining clamps 31, 131 are in a right-angled position to each other, the cam 45 rests in the other end area of the oblong hole 41. When both retaining clamps 31, 131 are in a parallel position, the cam 45 takes the position A at the end of the oblong hole 31 (FIG. 5). On the other hand, if the lower retaining clamp 131 is twisted in direction of the arrow X2 about the rotation axis 30*a* in direction of the arrow X2, the cam 45 is guided in the oblong hole 41 until the cam 45 has reached the end position B in the oblong hole 41 (FIG. 5). In the end positions A and B, the lower retaining clamp 131 is locked with respect to the upper retaining clamp 31 and when the upper lamella section 110 swivels about its vertical axis in direction of the arrow X3, the lower retaining clamp 131 is driven with the lower lamella section 120. By rotating manually the lower retaining clamp 131 to the upper retaining clamp 31, the angular position shown in FIG. 6 is then taken.

The rotary holding device 30 with its retaining clamps 31, 131 consists of plastic or of other appropriate materials. The flat bars 31', 131' of the retaining clamps 31, 131 of the rotary holding device 30 have a length which is bigger than the width of the individual vertical lamellae 10 so that the free ends 31'*d*, 31'*e* and 131'*d*, 131'*e* with the recesses 32, 32' and 132, 132' of the flat bars 31', 131' project laterally from the lamella sections 110, 120.

The partially circular oblong hole 41 in the disk body 133 of the lower retaining clamp 131 of the rotary holding device 30 corresponds approximately to the length of a quarter of a circle.

The holding together of both retaining clamps 31, 131 is obtained by the fact that the journal 35 engaging into the bore hole 36 in the disk body 133 on the lower retaining clamp 131 is provided with a bent grasping the edge of the bore hole 36 from behind so that a pulling off or a release of the upper retaining clamp 31 from the lower retaining clamp 131 is avoided. The disk bodies 33, 133, the journal 35 and the cam 45 are moulded on the retaining clamps 31, 131, i.e. the parts are constituted in one piece.

What is claimed is:

1. A vertical Venetian blind (100) comprising:

vertical lamellae (10) having a vertical longitudinal axis, respectively;

a support rail (15) in which the vertical lamellae (10) are arranged;

an operating cord (17) and an operating chain (16) connected to the vertical lamellae (10), wherein the operating cord (17) is configured to move the vertical lamellae (10) in a longitudinal direction of the support rail (15) and the operating chain (16) is configured to swivel the vertical lamellae (10) about the vertical longitudinal axes (11) for opening and closing the vertical Venetian blind;

the vertical lamellae (10) being made of strip shaped cut-out pieces made of a weft, cloth or foil, the vertical lamellae (10) having lower free ends (10*c*) being connected with each other with connecting cords, chains or bead chains (13) held on outer marginal edges (10*a*, 10*b*) of the lower free ends (10*c*);

wherein some of the vertical lamellae are divided into lamella sections (110, 120) connected to one another by lockable rotary holding devices (30) so as to be adjustable relative to one another;

wherein at least one section (90) of the vertical Venetian blind situated in a lower area of the Venetian blind has first ones of the lamella sections (120) which are manually adjustable vertical lamella sections (120);

wherein the connecting cords, chains or bead chains (13) connect the lower lamella sections (120) forming the lower free ends (10*c*) of the vertical lamellae (10);

wherein the first lamella sections (120) are configured to be manually swivelled about a vertical axis (121) of the first lamella sections (120) relative to second ones of the lamella sections (110) connected thereto by the rotary holding devices (30) into angular positions up to at least 90° relative to the second lamella section (110).

2. A vertical Venetian blind according to claim 1, wherein at least one of the vertical lamellae (10) consists of at least the first and second lamella sections (110, 120) complementing one another to a whole length of the at least one vertical lamella (10), wherein the rotary holding devices (30) are comprised of an upper retaining clamp (31) and a lower retaining clamp (131) twistable about a common vertical middle axis (30*a*) and arranged superimposed, the upper retaining clamp (31) being fixed to a lower free end (110*a*) of the second lamella section (110) and the lower retaining clamp (131) being held at upper end (120*a*) of the first lamella section (120) of the at least one vertical lamella (10), wherein a swivelling range or rotating range of the upper and lower retaining clamps (31, 131) to each other is limited by a locking device (40), wherein the second lamella sections (110) and the vertical lamellae (10), not divided into first and second lamella sections, are moved and swiveled by the operating cord (17) the operating chain (16) and the first lamella sections (120) are manually swivellable about the vertical axis (121) of the first lamella sections (120).

3. A vertical Venetian blind according to claim 1, wherein several of the vertical lamellae (10) consist of respectively one of the second lamella sections (110) and one of the first lamella sections (120).

4. A vertical Venetian blind according to claim 1, wherein all of the vertical lamellae (10) consist of respectively one of the first lamella sections (120) and one of the second lamella sections (110).

5. A vertical Venetian blind according to claim 1, wherein the first and second lamella sections (110, 120) have a same length.

6. A vertical Venetian blind according to claim 1, wherein the first and second lamella sections (110, 120) have a different length.

7. A vertical Venetian blind according to claim 2, wherein each one of the rotary holding devices (30) which respectively connects two lamella sections (110, 120) consists of an upper retaining clamp (31') and a lower retaining clamp (131') configured as flat bars (31', 131') with having upper longitudinal edges with rectangular or square recesses (32, 32', 132, 132') located at free ends of the flat bars, wherein the recesses are provided with openings (32*a*, 32'1, 132*a*, 132'*a*) at the upper longitudinal edges (31'*a*, 131'*a*) of the flat bars (31', 131'), respectively, wherein the flat bars (31; 131') have longitudinal edges (31'*b*, 131'*a*) facing each other and provided with a centrally arranged circular or partially circular disk body (33, 133), wherein the disk body (33) on the upper retaining clamp (31) has a journal (35) and the disk body (133) on the lower retaining clamp (131) has a bore hole (36) for receiving the journal (35) and constituting a rotation axis (30*a*), wherein the locking device (40) consists of a curved oblong hole (41) in the shape of a quarter of a circle or of a groove (41) in the disk body (133) of the lower retaining clamp (131) and of a cam (45) engaging the oblong hole (41) on a lower side of the disk body (33) of the upper retaining clamp (31) so that in a parallel position of the upper and lower retaining clamps (31, 131) the cam (45) rests in a first end area of the oblong hole (41) and in a right-angled position of the upper and lower retaining clamps (31, 131) to each other the cam (45) rests in a second end area (B) of the oblong hole (41).

8. A vertical Venetian blind according to claim 7, wherein the journal (35) is provided with a bent grasping an edge of the bore hole (36) from behind for preventing the upper retaining clamp (31) from being pulled off the lower retaining clamp (131).

9. A vertical Venetian blind according to claim 7, wherein the disk bodies (33, 133), the journal (35) and the cam (45) are moulded on the upper and lower retaining clamps (31, 131).

10. A vertical Venetian blind according to claim 7, wherein the rotary holding device (30) with the upper and lower retaining clamps (31, 131) is made of a synthetic material.

11. A vertical Venetian blind according to claim 7, wherein the flat bars (31', 131') have a length bigger than a width of individual ones of the vertical lamellae (10) so that the free ends (31'*d*, 31'*e*, 131'*d*, 131'*e*) of the flat bars (31 131') with the recesses (32, 32'; 132, 132') project laterally from the first and second lamella sections (110, 120).

12. A vertical Venetian blind according to claim 7, wherein the partially circular oblong hole (41) in the disk body (133) of the lower retaining clamp (131) approximately corresponds to a length of a quarter of a circle.

13. A vertical Venetian blind according to claim 7, wherein the second lamella sections (110) have lower free ends that are connected with each other on both vertical sides in the area of their lower free ends (110*a*) by additional ones of the connecting chains, connecting bead chains or connecting cords (13).

* * * * *